US009336796B2

(12) United States Patent
Jang et al.

(10) Patent No.: US 9,336,796 B2
(45) Date of Patent: May 10, 2016

(54) METHOD AND APPARATUS FOR DETECTING SPEECH/NON-SPEECH SECTION

(71) Applicant: Electronics and Telecommunications Research Institute, Daejeon-si (KR)

(72) Inventors: In Seon Jang, Daejeon (KR); Woo Taek Lim, Seoul (KR)

(73) Assignee: Electronics and Telecommunications Research Institute, Daejeon-si (KR)

( * ) Notice: Subject to any disclaimer, the term of this patent is extended or adjusted under 35 U.S.C. 154(b) by 168 days.

(21) Appl. No.: 14/172,998

(22) Filed: Feb. 5, 2014

(65) Prior Publication Data

US 2015/0149166 A1 May 28, 2015

(30) Foreign Application Priority Data

Nov. 27, 2013 (KR) ..... 10-2013-0144979

(51) Int. Cl.
*G10L 25/78* (2013.01)

(52) U.S. Cl.
CPC ..... *G10L 25/78* (2013.01)

(58) Field of Classification Search
None
See application file for complete search history.

(56) References Cited

U.S. PATENT DOCUMENTS

2005/0053242 A1* 3/2005 Henn ..... G10L 19/008 381/22
2006/0080089 A1* 4/2006 Vierthaler ..... G10L 21/0364 704/208
2007/0027686 A1* 2/2007 Schramm ..... G10L 13/00 704/235
2009/0276210 A1* 11/2009 Goto ..... G10L 19/008 704/211
2010/0121632 A1* 5/2010 Chong ..... G10L 19/0204 704/200.1
2010/0232619 A1* 9/2010 Uhle ..... G10L 21/0364 381/80
2011/0119061 A1* 5/2011 Brown ..... G10L 19/008 704/258

FOREIGN PATENT DOCUMENTS

JP 2006121152 A 5/2006
KR 1020060022156 A 3/2006
KR 1020080097684 A 11/2008
KR 1020130014895 A 2/2013
KR 1020130085731 A 7/2013

* cited by examiner

*Primary Examiner* — Jeremiah Bryar
(74) *Attorney, Agent, or Firm* — William Park & Associates Ltd.

(57) ABSTRACT

Provided is an apparatus for detecting a speech/non-speech section. The apparatus includes an acquisition unit which obtains inter-channel relation information of a stereo audio signal, a separation unit which separates each element of the stereo audio signal into a center channel element and a surround element on the basis of the inter-channel relation information, a calculation unit which calculates an energy ratio value between a center channel signal composed of center channel elements and a surround channel signal composed of surround elements, for each frame, and an energy ratio value between the stereo audio signal and a mono signal generated on the basis of the stereo audio signal, and a judgment unit which determines a speech section and a non-speech section from the stereo audio signal by comparing the energy ratio values.

12 Claims, 5 Drawing Sheets

FIG. 3

```
if (ER_CL[i] > alpha * ER_ML[i]) OR (ER_CR[i] > alpha * ER_MR[i])
        if (E_C[i] > beta)
                Speech
        else
                non-Speech
        end
else
        non-Speech
end
```

METHOD AND APPARATUS FOR DETECTING SPEECH/NON-SPEECH SECTION

Priority to Korean patent application number 2013-0144979 filed on Nov. 27, 2013, the entire disclosure of which is incorporated by reference herein, is claimed.

BACKGROUND OF THE INVENTION

1. Field of the Invention

The present invention relates to a method and apparatus for detecting a speech/non-speech section media contents where voice, music, sound effects, and noise are mixed.

2. Discussion of the Related Art

Various voice activity detection methods have been used to detect a speech section and a non-speech section in media contents.

For example, Korean Patent Publication No. 1999-0039422 (published on Jun. 5, 1999) "A method of measuring voice activity level for G.729 voice encoder" discloses dividing a voice frame into a speech section including voice information and a no-speech section, then dividing the speech section into voiced sounds and voiceless sounds so as to encode the sounds, and then measuring the activity level of sounds by comparing the energy of the voice frame obtained in the process of extracting LPC parameters with a threshold.

Furthermore, Korean Patent Publication No. 10-2013-0085731 (published on Jul. 30, 2013) "A method and apparatus for detecting voice area" discloses determining a speech section and a no-speech section within voice data by using a self-correlation value between voice frames.

However, such conventional methods detect a speech section by simply using a threshold, and thus errors may occur and detection of accurate speech sections may become difficult as noise is mixed and feature vectors significantly change. Furthermore, the conventional methods determine a voice and a no-voice, and thus it is difficult to apply such methods to media contents where music and sound effects, etc. coexist.

Furthermore, the technology of distinguishing voice from music is being developed as a preprocessing technology for improving performance of a voice recognition system. According to the existing voice/music classification methods, methods of distinguishing voice from music using a rhythm change according to time which may be considered as a main characteristic of music have been suggested. However, such methods are relatively slow compared to a voice change and the principle of changing at relatively constant intervals is used, and thus the performance may significantly change as the tempo gets quick and musical instruments change depending on the type of music.

Furthermore, methods of statistically extracting feature vectors having voice/music classification characteristics by utilizing a voice and music database (DB), and classifying voice/music by using a classifier which has been trained based on the extracted feature vectors have been studied. However, such methods require a learning step for voice/music classification of a high performance and a large amount of data needs to be secured for learning and statistical feature vectors need to be extracted based on the data, and thus a lot of effects and time are needed in securing data, extracting valid feature vectors and learning.

SUMMARY OF THE INVENTION

An object of the present invention is to provide a method and apparatus for detecting a speech/non-speech section which may detect a speech/non-speech section in an audio signal without advance training.

Another object of the present invention is to provide a method and apparatus for detecting a speech/non-speech section which may detect accurately detect a speech/non-speech section from audio signals with only a little amount of calculation and memory.

In accordance with an aspect of the present invention, an apparatus for detecting a speech/non-speech section includes an acquisition unit which obtains inter-channel relation information of a stereo audio signal, a separation unit which separates each element of the stereo audio signal into a center channel element and a surround element on the basis of the inter-channel relation information, a calculation unit which calculates an energy ratio value between a center channel signal composed of center channel elements and a surround channel signal composed of surround elements, for each frame, and an energy ratio value between the stereo audio signal and a mono signal generated on the basis of the stereo audio signal, and a judgment unit which determines a speech section and a non-speech section from the stereo audio signal by comparing the energy ratio values.

The inter-channel relation information may include information on a level difference between channels of the stereo audio signal and information on a phase difference between channels.

The inter-channel relation information may further include inter-channel correlation information of the stereo audio signal.

The center channel signal may be generated by performing an inverse spectrogram using the center channel elements, and the surround channel signal may be generated by performing an inverse spectrogram using the surround elements.

The judgment unit may determine that the detected section is a speech section when an energy value in a section, which is detected as the speech section on the basis of the energy value of the center channel signal for each frame, is greater than the threshold.

In accordance with another aspect of the present invention, a method of detecting a speech/non-speech section by a speech/non-speech section detection apparatus includes obtaining inter-channel relation information of a stereo audio signal, generating a center channel signal composed of center channel elements and a surround channel signal composed of surround elements on the basis of the inter-channel relation information, calculating an energy ratio value between the center channel signal and the surround channel signal, for each frame, and an energy ratio value between the stereo audio signal and a mono signal generated on the basis of the stereo audio signal, and detecting a speech section and a non-speech section from the stereo audio signal by comparing the energy ratio values.

BRIEF DESCRIPTION OF THE DRAWINGS

FIG. 3 is a pseudo code showing determination criteria for a speech/non-speech section according to an embodiment of the present invention;

DETAILED DESCRIPTION OF THE EMBODIMENTS

Figure 1:
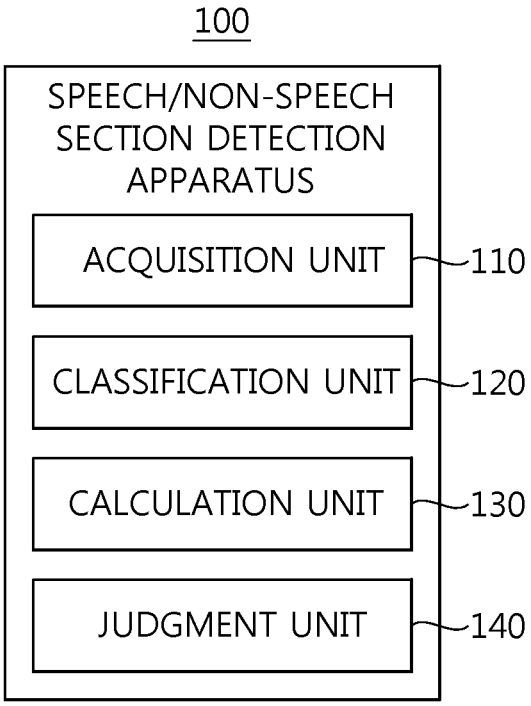
FIG. 1 is a block diagram of a speech/non-speech section detection apparatus, according to an embodiment of the present invention.

Hereinafter, embodiments of the present invention will be described in detail with reference to the accompanying drawings so that they can be readily implemented by those skilled in the art.

Hereinafter, some embodiments of the present invention are described in detail with reference to the accompanying drawings in order for a person having ordinary skill in the art to which the present invention pertains to be able to readily implement the invention. It is to be noted the present invention may be implemented in various ways and is not limited to the following embodiments. Furthermore, in the drawings, parts not related to the present invention are omitted in order to clarify the present invention and the same or similar reference numerals are used to denote the same or similar elements.

The objects and effects of the present invention can be naturally understood or become clear by the following description, and the objects and effects of the present invention are not restricted by the following description only.

The objects, characteristics, and merits will become more apparent from the following detailed description. Furthermore, in describing the present invention, a detailed description of a known art related to the present invention will be omitted if it is deemed to make the gist of the present invention unnecessarily vague. A preferred embodiment in accordance with the present invention is described in detail below with reference to the accompanying drawings.

FIG. 1 is a block diagram of a speech/non-speech section detection apparatus, according to an embodiment of the present invention. Referring to FIG. 1, a speech/non-speech section detection apparatus 100 according to an embodiment of the present invention includes an acquisition unit 110, a separation unit 120, a calculation unit 130, and a judgment unit 140.

The acquisition unit 110 acquires relation information between channels of an audio signal from the audio signal. To this end, the acquisition unit 110 may receive an audio signal. The audio signal may be a stereo signal including a plurality of channels. The relation information between channels may include information on an inter-channel level difference (ILD) and information on an inter-channel phase difference. Furthermore, the inter-channel relation information may further include inter-channel correlation (ICC) information of the audio signal as necessary.

The inter-channel relation information is calculated for one element having a specific frame and frequency value when short-time-Fourier-transformed (STFT) left channel signals and right channel signals are considered as a complex number spectrogram matrix. The acquisition unit 110 may obtain inter-channel relation information by extracting ILD, IPD, etc. for each element of the audio signal.

The separation unit 120 separates each element of the audio signal into a center channel element and a surround element on the basis of the inter-channel relation information obtained in the acquisition unit 110. For example, the separation unit 120 may separate each of the elements by determining the element as a center channel element if the ILD and IPD of the element is smaller than a specific threshold, and determining the element as a surround element if the ILD and IPD of the element is greater than the threshold. Thereafter, the separation unit 120 separates the audio signal into a center channel signal and a surround channel signal by generating the center channel signal and the surround signal by performing an inverse spectrogram for the result of collection of center channel elements and surround elements.

The calculation unit 130 calculates the energy ratio value between a center channel signal and a surround channel signal, which are outputted from the separation unit 120, for each frame, and calculates the energy ratio value between the audio signal and a mono signal which is generated based on the audio signal, for each frame. To this end, the calculation unit 130 respectively calculates the energy value of the center channel signal and the surround channel signal, for each channel, and calculates the energy ratio value between the center channel signal and the surround channel signal, for each frame, based on the energy value of the center channel and the surround channel signal, for each frame. Furthermore, the calculation unit 130 generates a mono signal based on the audio signal and respectively calculates the energy value of the mono signal and the audio signal, for each frame, and then calculates the energy ratio value between the mono signal and the audio signal, for each frame, based on the energy value of the mono signal and the audio signal, for each frame.

The judgment unit 140 determines a speech section and a non-speech section from the audio signal by comparing energy ratio values calculated in the calculation unit 130. For example, if the energy ratio value between the center channel signal and the surround channel signal is greater than the energy value of the mono signal and the audio signal, for each frame, the judgment unit 140 may detect the section primarily as the speech section. Here, the energy value of the mono signal and the audio signal, for each frame, may be compared with the energy ratio value of the center channel signal and the surround channel signal after a gain value for setting the threshold is added. Furthermore, if the energy value in the section, which has been detected as the speech section based on the energy value of the center channel signal calculated in the calculation unit, for each frame, is greater than the threshold, the judgment unit 140 may determine the detected section as a speech section.

Figure 2:
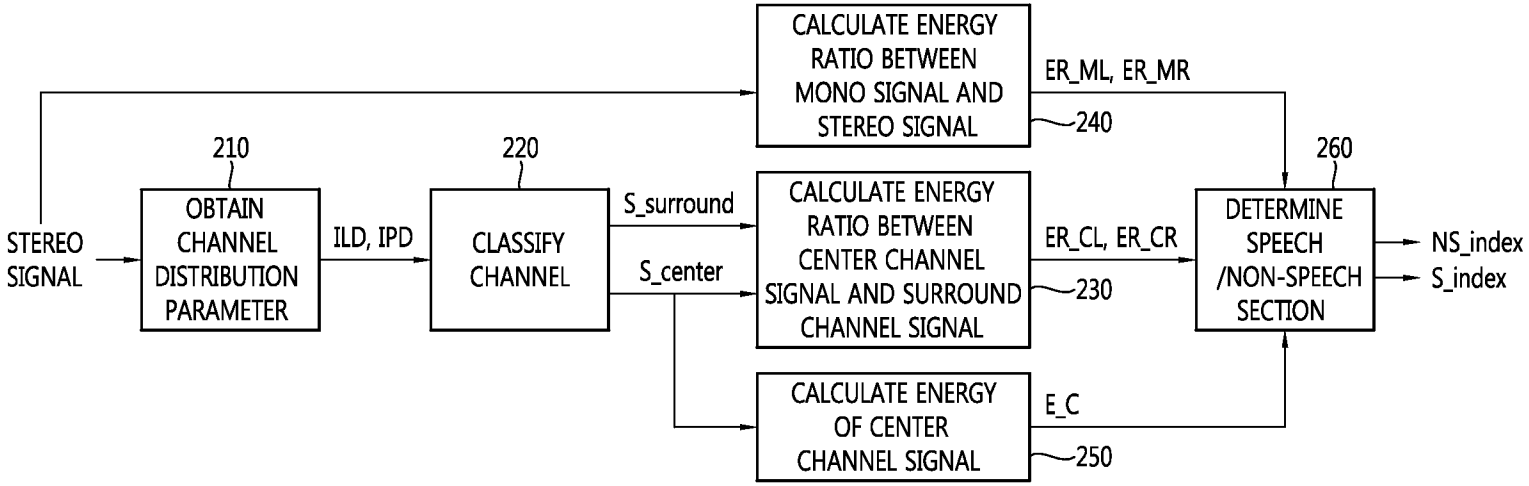
FIG. 2 illustrates a process of detecting a speech/non-speech section according to an embodiment of the present invention.

FIG. 2 illustrates a process of detecting a speech/non-speech section according to an embodiment of the present invention, and FIG. 3 is a pseudo code showing determination criteria for a speech/non-speech section according to an embodiment of the present invention.

Referring to FIG. 2, a stereo signal may be inputted to the acquisition unit 110. Then the acquisition unit 110 obtains a channel distribution parameter by extracting inter-channel level difference (ILD) and inter-channel phase difference (IPD) information as relation information between a plurality of channels from an inputted stereo signal (210). Various parameters, which may be used in expressing inter-channel information such as inter-channel correlation (ICC) information may be utilized depending on the case when determining the speech/non-speech section. The channel distribution parameter is calculated for one element having a specific frame and frequency value when considering the short-time-Fourier-transformed (STFT) left channel signal and right channel signal as a complex number spectrogram matrix. Thereafter, the acquisition unit 110 outputs ILD, IPD, etc. according to each element, and the ILD and the IPD for each outputted element are inputted to the separation unit 120.

If the ILD and the IPD are smaller than a specific threshold for each element, the separation unit 120 separates the element as the center channel element, and if the ILD and the IPD are greater than the threshold for each element, the separation unit 120 separates the element as the surround element (220). Thereafter, the center channel signal (S_center) and the surround channel signal (S_surround) are formed and outputted by performing an inverse spectrogram after collecting the center channel elements and surrounding elements. Then the calculation unit 130 calculates the energy value of the center channel signal (S_center) and the surround channel signal (S_surround), for each frame, and calculates the ratio value of the energy for each calculated frame by using the following equation 1 (230).

$$ER_CL[i]=E(S_\text{center}[i])/E(LS_\text{surround}[i]),$$

$$ER_CR[i]=E(S_\text{center}[i])/E(RS_\text{surround}[i]) \quad \text{Equation 1}$$

Here, ER_CL[i] and ER_CR[i] respectively denote the energy ratio value between the center channel signal and a left surround signal and the energy ratio value between the center channel signal and a right surround signal in the ith frame. E(.) is a function of calculating the energy value, and LS_surround and RS_surround respectively denote a left channel signal and a right channel signal of the surround channel signal.

Furthermore, the calculation unit 130 receives a stereo signal and generates a mono signal. Furthermore, the energy value of the generated mono signal and stereo signal for each frame is calculated, and the energy ratio value for each calculated frame is calculated using the following equation 2 (240).

$$ER_ML[i]=E(M[i])/E(L[i]),$$

$$ER_MR[i]=E(M[i])/E(R[i]) \quad \text{Equation 2}$$

Here, ER_ML[i] and ER_MR[i] denote the energy ratio value between a mono signal M and a left channel signal L within a stereo signal, and the energy ratio value between the mono signal M and a right channel signal R within the stereo signal in ith frame, respectively. E(.) is a function of calculating the energy value, and the calculation is performed as in the following equation 3.

$$E(L[i]) = \frac{1}{N}\sum_{k=1}^{N} L(k) \quad \text{Equation 3}$$

Here, k is a sample index, and N is the length of a frame.

Furthermore, the calculation unit 130 calculates the energy value for each frame of the center channel signal (S_center) by using the following equation 4 (250).

$$E_C[i]=E(S_\text{center}[i]) \quad \text{Equation 4}$$

Here, E_C[i] denotes the energy value of the center channel signal in the ith frame.

The judgment unit 140 detects the speech/non-speech section by comparing the energy ratio values ER_CL, ER_ML, ER_CR, and ER_MR which are first inputted. Generally, the sound source, which gives important information to the user, such as a speech, is located in the center channel. Hence, when the ER_CL is greater than the ER_ML or the ER_CR is greater than the ER_MR, the judgment unit 140 may determine the section as a speech section (260).

For example, when preparing the actual broadcast contents, audio is recorded on the spot by using a mono or stereo microphone, and after the recording a producer prepares a program by performing a mixing work in a studio, such as music addition and sound effect amplification while checking the recorded result. At the on-the-spot recording, the voice of an actor is recorded by using a super-directional or directional microphone, and thus the sound signals are distributed in the center channel within the broadcast contents.

In the studio, stereo music and sound effects are added to the spot-recorded audio. Hence, in the frame corresponding to the voice, the energy ratio between the center channel signal and the surround channel signal is greater than the energy ratio between the mono signal and the stereo signal. Furthermore, in the case of signals which are not the voice, such as music, which has been added through the mixing work in the studio, the energy ratio between the center channel signal and the surround channel signal becomes smaller than the energy ratio between the mono signal and the stereo signal. The same is applied to a news program which is prepared as live broadcasting. The judgment unit 140 primarily determines whether the section is a speech section based thereon, and if it is determined that the section is the speech section, the energy value for each frame is calculated to more accurately determine the activity level of the voice located on the center channel sound image, then if the energy value in a specific frame is greater than the threshold, the judgment unit 140 determines that the section is a speech section, and if the energy value is smaller than the threshold, the judgment unit 140 may determine that the section is a non-speech section.

The pseudo code, which becomes the criterion for determining the speech/non-speech section is shown in FIG. 3. In FIG. 3, the alpha denotes a gain value for setting the energy ratio threshold, and the beta denotes a threshold of the energy for each frame. The judgment unit 140 may determine whether a section is a speech section depending on the criteria of FIG. 3 and output the result.

Figure 4:
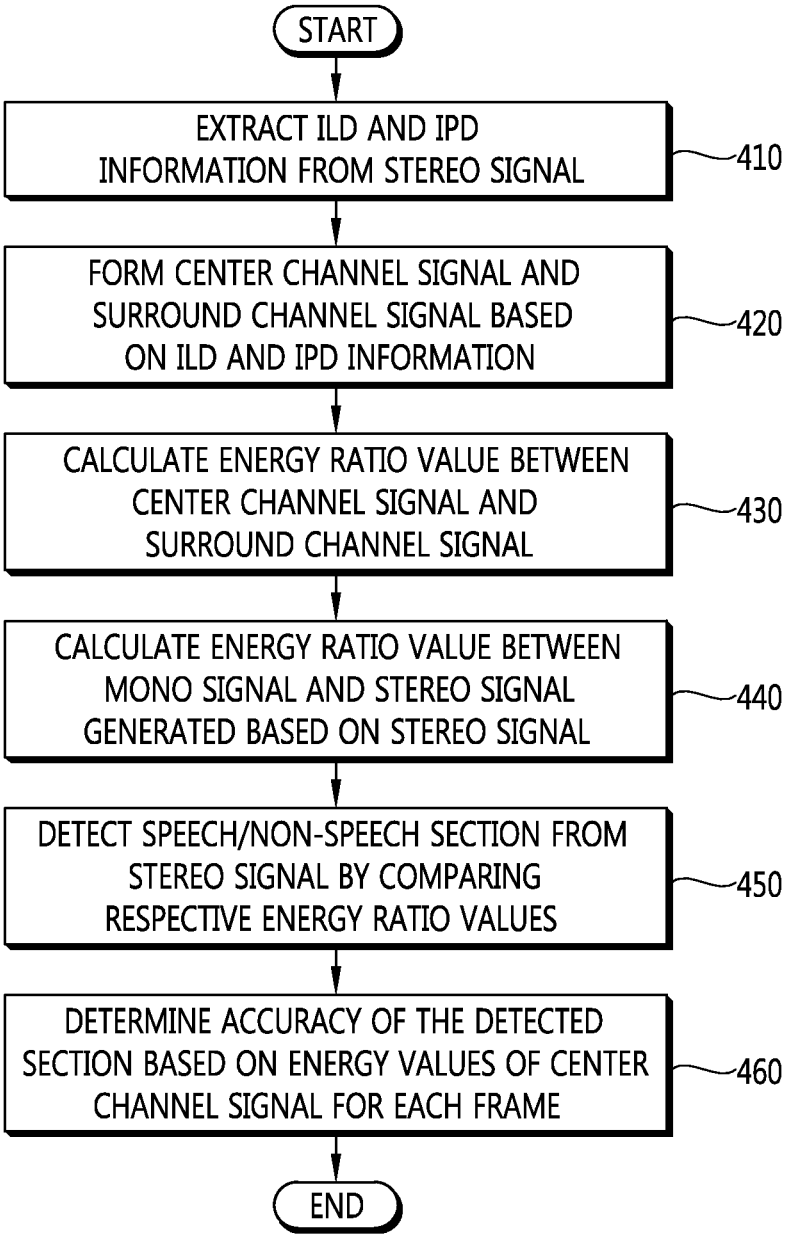
FIG. 4 is a flowchart of a method of detecting a speech/non-speech section according to an embodiment of the present invention.

FIG. 4 is a flowchart of a method of detecting a speech/non-speech section according to an embodiment of the present invention.

The speech/non-speech section detection apparatus obtains inter-channel relation information of the audio signal by extracting the ILD and IPD, etc. from the audio signal in order to detect the speech section and the non-speech section from the audio signal (410). Here, the audio signal may be a stereo signal including a plurality of channels. The speech/non-speech section detection apparatus may extract inter-channel correlation information as the inter-channel relation information as necessary.

Thereafter, the speech/non-speech section detection apparatus separates each element of the audio signal into a center channel clement and a surround element on the basis of the extracted inter-channel relation information, and generates a center channel signal (S_center) composed of center channel elements and a surround channel signal (S_surround) composed of surround elements (420). At this time, the center channel signal (S_center) and the surround channel signal (S_surround) may be generated by performing an inverse spectrogram using center channel elements respectively and by performing an inverse spectrogram using surround elements.

If the center channel signal (S_center) and the surround channel signal (S_surround) are generated, the speech/non-speech section detection apparatus calculates the energy ratio value (ER_CL, ER_CR) between the center channel signal and the surround channel signal, for each frame, and the energy ratio value (ER_ML, ER_MR) between the audio signal and a mono signal which is generated based on the audio signal, for each frame.

In detail, the speech/non-speech section detection apparatus respectively calculates the energy value of the center channel signal (S_center) and the surround channel signal (S_surround) for each frame, and calculates the energy ratio value (ER_CL, ER_CR) between the center channel signal and the surround channel signal for each frame on the basis of the calculated energy values for each frame (430). Furthermore, the energy value of the mono signal and the audio signal which are generated based on the audio signal, for each frame, is calculated, and the energy ratio value (ER_ML, ER_MR) between the mono signal and the audio signal for each frame is calculated based on the energy value for each frame (440).

If the energy ratio values (ER_CL, ER_CR, ER_ML, ER_MR) between respective signals are calculated through the above-described processes, the speech/non-speech section detection apparatus primarily detects the speech section and the non-speech section from the audio signal by comparing the energy ratio values (ER_CL, ER_CR, ER_ML, ER_MR) (450). Thereafter, if the energy value in the section, which is detected as the voice section on the basis of the energy value (E_C) of the center channel signal for each frame, is greater than the threshold, it is determined that the detected section is a voice section, and if the energy value is the threshold value or less, it is determined that the detected section is a non-speech section (460).

According to the present invention, it is possible to detect a speech/non-speech section from audio signals without temporal or man power consumption such as securing a database for voice and music, extracting statistically valid characteristics, and advance training.

An accurate speech/non-speech section detection is possible with only a little amount of calculation and memory consumption for analyzing characteristics between audio channels and characteristics of signals for each channel, and the service quality of devices may be improved by being applied to a sound editing device and preprocessing of a data search method, etc.

Figure 5:
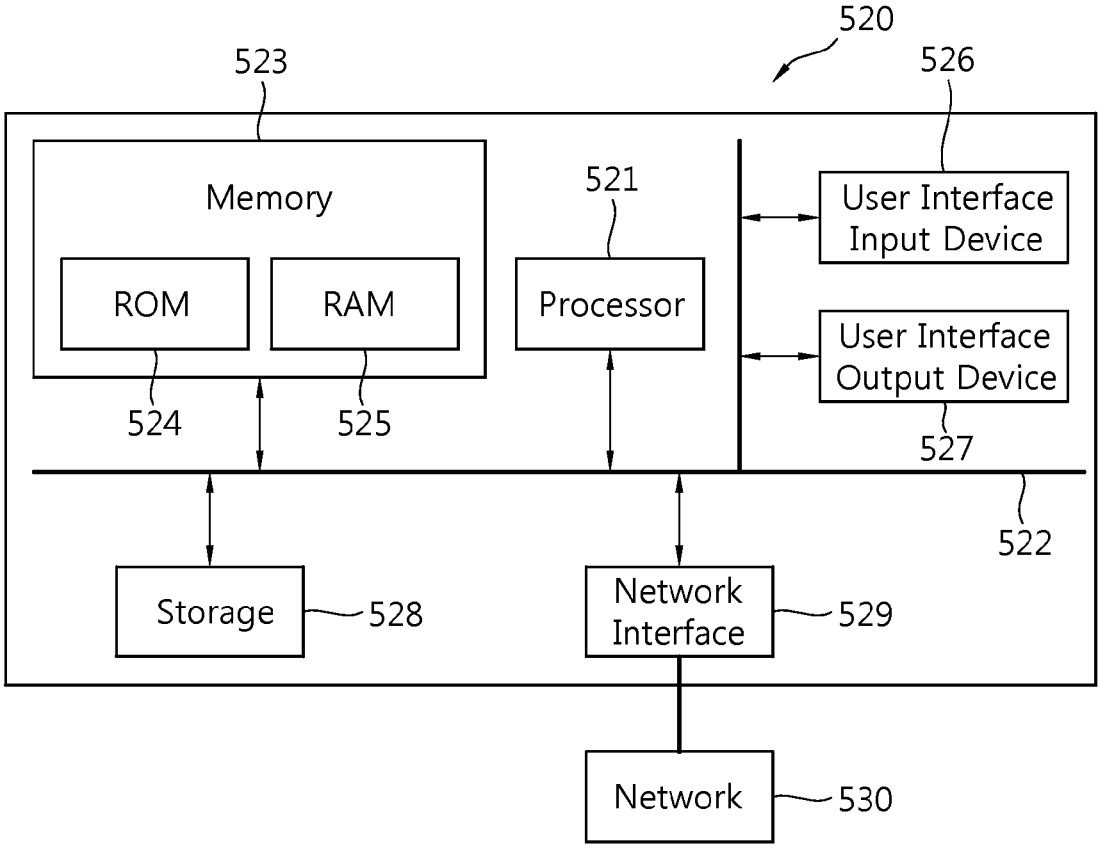
FIG. 5 is a block diagram of a computer system, according to an embodiment of the present invention.

An embodiment of the present invention may be implemented in a computer system, e.g., as a computer readable medium. As shown in in FIG. 5, a computer system 520 may include one or more of a processor 521, a memory 523, a user input device 526, a user output device 527, and a storage 528, each of which communicates through a bus 522. The computer system 520 may also include a network interface 529 that is coupled to a network. The processor 521 may be a central processing unit (CPU) or a semiconductor device that executes processing instructions stored in the memory 523 and/or the storage 528. The memory 523 and the storage 528 may include various forms of volatile or non-volatile storage media. For example, the memory may include a read-only memory (ROM) 524 and a random access memory (RAM) 525.

Accordingly, an embodiment of the invention may be implemented as a computer implemented method or as a non-transitory computer readable medium with computer executable instructions stored thereon. In an embodiment, when executed by the processor, the computer readable instructions may perform a method according to at least one aspect of the invention.

A person having ordinary skill in the art to which the present invention pertains may change and modify the present invention in various ways without departing from the technical spirit of the present invention. Accordingly, the present invention is not limited to the above-described embodiments and the accompanying drawings.

In the above exemplary system, although the methods have been described based on the flowcharts in the form of a series of steps or blocks, the present invention is not limited to the sequence of the steps, and some of the steps may be performed in a different order from that of other steps or may be performed simultaneous to other steps. Furthermore, those skilled in the art will understand that the steps shown in the flowchart are not exclusive and the steps may include additional steps or that one or more steps in the flowchart may be deleted without affecting the scope of the present invention.

What is claimed is:

1. An apparatus for detecting a speech/non-speech section, the apparatus comprising:

an acquisition unit which obtains inter-channel relation information of a stereo audio signal;

a separation unit which separates each element of the stereo audio signal into a center channel element and a surround element on the basis of the inter-channel relation information;

a calculation unit which calculates an energy ratio value between a center channel signal composed of center channel elements and a surround channel signal composed of surround elements, for each frame, and an energy ratio value between the stereo audio signal and a mono signal generated on the basis of the stereo audio signal; and a judgment unit which determines a speech section and a non-speech section from the stereo audio signal by comparing the energy ratio values.

2. The apparatus of claim 1, wherein the inter-channel relation information comprises information on a level difference between channels of the stereo audio signal and information on a phase difference between channels.

3. The apparatus of claim 2, wherein the inter-channel relation information further comprises inter-channel correlation information of the stereo audio signal.

4. The apparatus of claim 1, wherein the center channel signal is generated by performing an inverse spectrogram using the center channel elements, and the surround channel signal is generated by performing an inverse spectrogram using the surround elements.

5. The apparatus of claim 1, wherein the judgment unit determines that the detected section is a speech section when an energy value in a section, which is detected as the speech section on the basis of the energy value of the center channel signal for each frame, is greater than the threshold.

6. A method of detecting a speech/non-speech section by a speech/non-speech section detection apparatus, the method comprising:

obtaining inter-channel relation information of a stereo audio signal;

generating a center channel signal composed of center channel elements and a surround channel signal composed of surround elements on the basis of the inter-channel relation information;

calculating an energy ratio value between the center channel signal and the surround channel signal, for each frame, and an energy ratio value between the stereo audio signal and a mono signal generated on the basis of the stereo audio signal; and detecting a speech section and a non-speech section from the stereo audio signal by comparing the energy ratio values.

7. The method of claim 6, wherein the inter-channel relation information comprises information on a level difference between channels of the stereo audio signal and information on a phase difference between channels.

8. The method of claim 7, wherein the inter-channel relation information further comprises inter-channel correlation information of the stereo audio signal.

9. The method of claim 6, after the obtaining, further comprising: separatinq each element of the stereo audio signal into a center channel element and a surround element on the basis of the inter-channel relation information.

10. The method of claim 6, wherein the generating comprises:

generating the center channel signal by performing an inverse spectrogram using the center channel elements; and generating the surround channel signal by performing an inverse spectrogram using the surround elements.

11. The method of claim 6, wherein the calculating comprises:

calculating an energy ratio value between the center channel signal and the surround channel signal, for each frame, and an energy ratio value between the center channel signal and the surround channel signal, for each frame, on the basis of the energy value of the center channel signal and the surround channel signal, for each frame; and calculating an energy value of the stereo audio signal and a mono signal which is generated on the basis of the stereo audio signal, for each frame, and an energy ratio value between the mono signal and the stereo audio signal, for each frame, on the basis of the energy value of the mono signal and the stereo audio signal, for each frame.

12. The method of claim 6, wherein the determining comprises:

determining that the detected section is a speech section when an energy value in a section, which is detected as the speech section on the basis of the energy value of the center channel signal for each frame, is greater than the threshold, and determining that the detected section is a non-speech section when the energy value is the threshold or less.

* * * * *